US005326153A

United States Patent [19]

Muffi

[11] Patent Number: 5,326,153

[45] Date of Patent: Jul. 5, 1994

[54] SOFA, LOVE SEAT, SECTIONAL OR MODULAR FURNITURE ARRANGEMENT WITH GLIDER/ROCKER RECLINER

[76] Inventor: James V. Muffi, Rte. 7, Box 399, Tupelo, Miss. 38801

[21] Appl. No.: 963,845

[22] Filed: Oct. 20, 1992

[51] Int. Cl.[5] ..... A47C 15/00; A47C 1/02

[52] U.S. Cl. ..... 297/232; 297/68; 297/DIG. 7

[58] Field of Search ..... 297/232, 68, 84, DIG. 7; D6/335

[56] References Cited

U.S. PATENT DOCUMENTS

| | | | |
|---|---|---|---|
| D. 332,879 | 2/1993 | Gera | D6/335 |
| 4,519,647 | 5/1985 | Rogers, Jr. | 297/DIG. 7 |
| 5,064,244 | 11/1991 | Sproule | 297/DIG. 7 |
| 5,147,108 | 9/1992 | LaPointe | 297/84 |

*Primary Examiner*—Alexander Grosz
*Attorney, Agent, or Firm*—Phelps Dunbar

[57] ABSTRACT

A sofa, love seat, sectional or modular furniture arrangement that includes a glider/rocker recliner as an integral part of the sofa or love seat, or as a portion of a sectional or modular furniture arrangement.

5 Claims, 3 Drawing Sheets

SOFA, LOVE SEAT, SECTIONAL OR MODULAR FURNITURE ARRANGEMENT WITH GLIDER/ROCKER RECLINER

FIELD OF INVENTION

This invention relates to motion furniture containing glider/rocker recliners, and more particularly to sofas, love seats, sectional and modular furniture arrangements which contain or include one or more glider/-rocker recliners.

BACKGROUND OF THE INVENTION

Consumer acceptance of motion furniture has dramatically increased over the past several years. Initially introduced as stand alone units, some types of incliners and recliners are now marketed as components of sofas, love seats, sectional or modular arrangements. However, certain types of motion furniture have been offered to consumers only as stand alone units. For example, a type of motion furniture known as a glider/rocker recliner has heretofore only been produced as a stand alone unit. This type of motion furniture was previously thought unusable and unacceptable as a component of sofas, love seats, sectional or modular arrangements.

SUMMARY OF THE INVENTION

The principle object of the present invention is to provide a sofa, love seat, sectional or modular arrangement which includes one or more glider/rocker recliners as components of the furniture.

Glider/rocker recliners are a type of motion furniture which, as their name implies, combine characteristics of three types of chairs. Initially, the glider/rocker recliner is capable of "gliding" back and forth. When gliding, the seat moves back and forth in a plane generally parallel to the surface upon which the chair rests. The back of the chair need not move out of a series of parallel planes during the gliding operation. Secondly, the glider/rocker recliner is capable of rocking. When rocking, the seat and back rotate back and forth as a unit about an axis generally located beneath the chair seat. Typically, glider/rocker recliners do not have the curved rails contacting the surface upon which the chair rests as typical rocking chairs usually have. Instead, the chair is suspended in a frame in a manner which provides for a rocking movement similar to that generated by the curved rails of a typical rocking chair. Glider/rocker recliners are capable of both gliding and rocking at the same time. When this occurs the axis about which the chair rocks glides back and forth in a plane parallel to the surface upon which the chair rests, while at the same time the seat and back rotate back and forth about this same axis. Thirdly, the glider/rocker recliner is capable of reclining. A reclining chair generally enables the occupant to change the angle between the seat and back rest of the chair, forming an increasingly flat surface upon which to "recline." Additionally, a reclining chair usually includes a footrest capable of supporting the feet and lower legs of the chair occupant in one or more positions. Glider/rocker recliners are generally capable of gliding and/or rocking in fully or partially reclined positions with or without the footrest fully or partially extended.

It was previously thought that glider/rocker recliners as described above were incompatible with sofas, love seats, sectional or modular furniture arrangements. The present invention contemplates the use of glider/-rocker recliners in various types of furniture in a manner heretofore thought unworkable or impractical.

DETAILED DESCRIPTION OF THE PREFERRED EMBODIMENT

Figure 1:
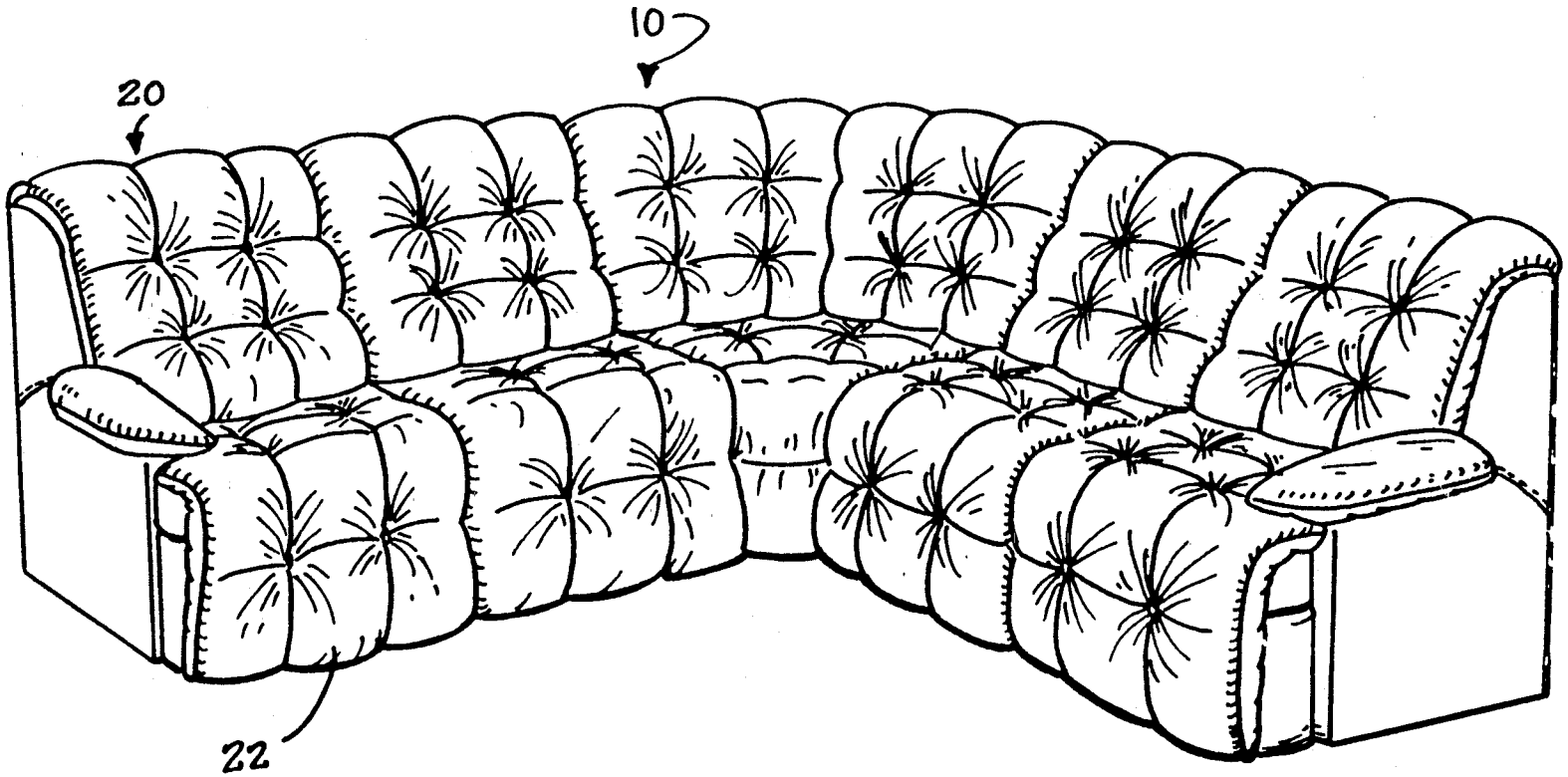
FIG 1 is a perspective view of a sectional furniture arrangement containing a glider/rocker recliner in the fully upright position.
Figure 2:
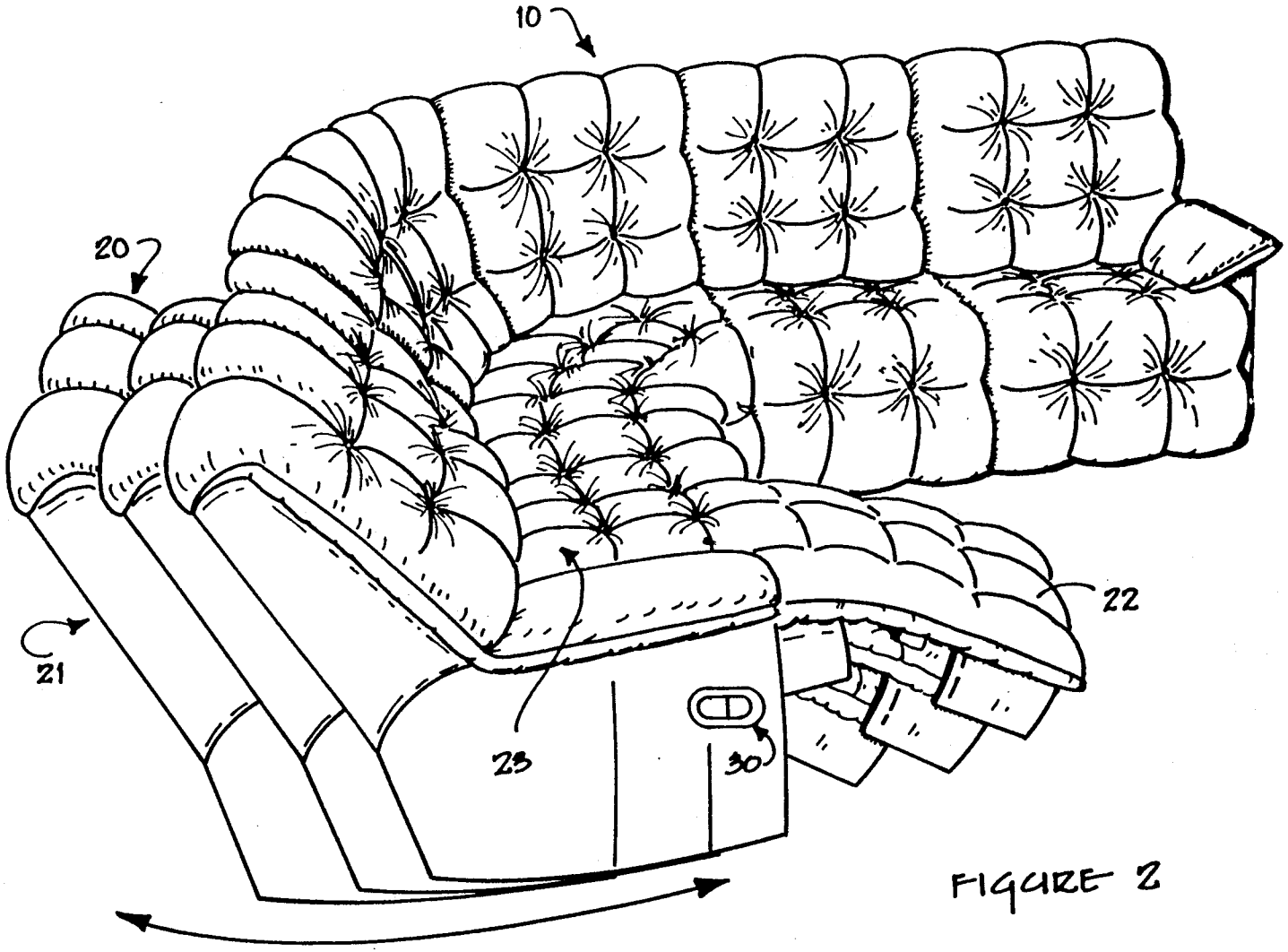
FIG. 2 is a perspective view of a sectional furniture arrangement containing a glider/rocker recliner showing the glider/rocker recliner partially reclined with footrest extended, and also showing the gliding movement of the glider/rocker recliner.

FIG. 1 shows a typical sectional furniture arrangement 10. A glider/rocker recliner 20 forms a portion of the sectional arrangement 10. In FIG. 1 the glider/-rocker recliner 20 is in its fully upright position, with the footrest 22 in the non-extended position, such that the glider/rocker recliner 20 appears similar to any other piece of non-motion furniture in the sectional arrangement 10. FIG. 2 shows the glider/rocker recliner 20 partially reclined, as evidenced by the change in the angle between the seat back 21 and the seat 23, relative to the angle shown in FIG. 1. FIG. 2 also shows the footrest 22 extended. The ability of the occupant to recline the chair or extend the footrest 22 may be controlled by a lever or button located at various positions on the chair. In FIG. 2 the control device 30 is shown on the outside of the exposed side of the glider/rocker recliner 20. FIG. 2 also shows the glider/rocker recliner 20 in three different positions along its glide path.

Figure 3:
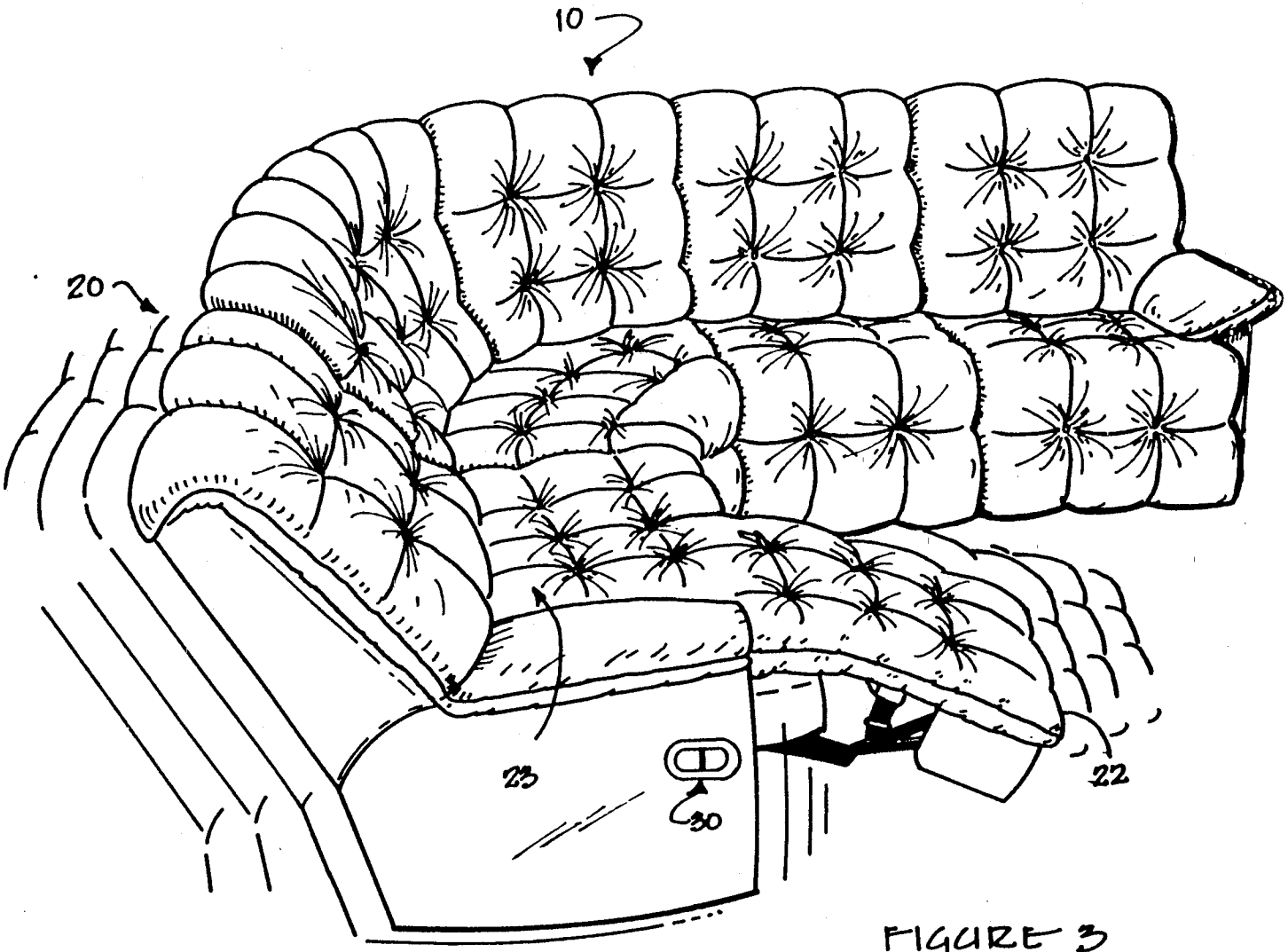
FIG. 3 is a perspective view of a sectional furniture arrangement containing a glider/rocker recliner showing the glider/rocker recliner partially reclined, with footrest extended, and also showing the rocking movement of the glider/rocker recliner.

FIG. 3 also shows the glider/rocker recliner 20 in a partially reclined position with the footrest 22 extended. However, FIG. 3 illustrates the rocking motion of the glider/rocker recliner 20 about an axis located generally beneath the chair seat 23.

The occupant of the glider/rocker recliner 20 can initiate a gliding or rocking motion, or both, by either pushing or pulling against the adjacent chair, or against the floor with his feet when the footrest 22 is not extended. Alternatively, the occupant of the glider/-rocker recliner 20 can manipulate his body weight in a manner which initiates such motion. There are mechanisms currently on the market which allow both gliding and rocking to occur simultaneously with or without the glider/rocker recliner 20 in a reclined position and with or without the footrest 22 extended.

The motion of the glider/rocker recliner 20 prevents the sofa, love seat, sectional or modular furniture arrangement of which it forms a part from being located immediately adjacent to a wall. Accordingly the sofa, love seat, sectional or modular furniture arrangement containing a glider/rocker recliner 20 should be fully finished on its back side, since this side will likely be visible from some locations.

More than one glider/rocker recliner may be placed in a sofa, love seat, sectional or modular furniture arrangement. Additionally, glider/rocker recliners are not limited to appearing on the ends of such furniture. Glider/rocker recliners may be used as an interior seat of a sofa, sectional or modular furniture arrangement. Such a use would require repositioning of the control mechanism. A lever or pull strip may be placed between the seat cushions of the glider/rocker recliner and the adjacent chair seat.

In modular arrangements the glider/rocker recliner need not be physically attached to the adjacent element of the furniture arrangement. However, in sofas, love seats and units of a sectional arrangement it is desirable to physically attach the glider/rocker recliner to the adjacent part of the furniture. Such attachment must be done in a manner which does not interfere with the motion of the glider/rocker recliner. Typically the glider/rocker recliner is built on a frame such that the legs of the frame do not move relative to the surface upon which the glider/rocker recliner rests when the glider/-rocker recliner is in motion. Accordingly, the attachment of the glider/rocker recliner to the adjacent portion of the sofa, love seat, or sectional arrangement of furniture should be to the frame of the glider/rocker recliner. Alternatively, the frame of the glider/rocker recliner can be incorporated into the frame of the sofa, love seat, or sectional arrangement of which the glider/rocker recliner is a part.

It should be understood that the preceding is merely a detailed description of a preferred embodiment of this invention and that various modifications and equivalents can be made without departing from the spirit of scope of the invention. The preceding description, therefore, is not meant to limit the scope of the invention. Rather, the scope of the invention is to be determined by the appended claims and their equivalents.

What is claimed is:

1. A sofa, love seat, sectional or modular furniture arrangement comprising:

at least one seating section, and at least one glider/rocker recliner without an arm at one end placed adjacent to said seating section, whereby said seating section and said glider/rocker recliner together form the sofa, love seat, sectional or modular furniture arrangement.

2. The sofa, love seat, sectional or modular furniture arrangement as set forth in claim 1 wherein one of said glider/rocker recliners is placed at each end of the sofa, love seat, sectional or modular furniture arrangement.

3. A sofa, sectional or modular furniture arrangement comprising:

at plurality of seating sections, and at least one glider/rocker recliner without arms placed adjacent two of said seating sections at an interior location of the sofa, sectional or modular furniture arrangement.

4. The sofa, sectional or modular furniture arrangement as set forth in claim 3 further comprising glider/-rocker recliners without an arm at one end placed at one or both ends of the sofa, sectional or modular furniture arrangement.

5. The sofa, love seat, sectional or modular furniture arrangement as set forth in claims 1, 2, 3, or 4 wherein said glider/rocker recliners are incorporated into the sofa, love seat, sectional or modular furniture arrangement through the use of a common frame.

* * * * *